US005490528A

United States Patent [19]

Day

[11] Patent Number: 5,490,528

[45] Date of Patent: Feb. 13, 1996

[54] FITTED HAIR TOWEL

[76] Inventor: Scott A. Day, 14277 Preston Rd., Suite 1022, Dallas, Tex. 75240

[21] Appl. No.: 261,835

[22] Filed: Jun. 17, 1994

[51] Int. Cl.[6] ..... A45D 20/00

[52] U.S. Cl. ..... 132/200; 132/212; 2/174; 2/202

[58] Field of Search ..... 132/273, 274, 132/212, 200; 2/174, 202, 207, 208; D6/608

[56] References Cited

U.S. PATENT DOCUMENTS

| | | | |
|---|---|---|---|
| 1,577,945 | 3/1926 | Blumental . | |
| 1,589,185 | 6/1926 | Lithgow | 132/273 X |
| 1,610,480 | 12/1926 | Seilaz | 132/274 |
| 1,652,933 | 12/1927 | Gaskell . | |
| 1,948,556 | 2/1934 | Armsby | 2/174 |
| 2,263,418 | 11/1941 | Ganim . | |
| 2,568,399 | 9/1951 | Kahn . | |
| 2,694,204 | 11/1954 | Cross . | |
| 2,698,944 | 1/1955 | Younghusband-Ramsby . | |
| 4,110,846 | 9/1978 | Hernandez | 2/203 |
| 4,790,035 | 12/1988 | Whyte | 2/207 |
| 5,365,613 | 11/1994 | Henegan | 2/174 |

*Primary Examiner*—John G. Weiss
*Attorney, Agent, or Firm*—Harris, Tucker & Hardin

[57] ABSTRACT

A fitted hair towel (1) for drying hair naturally, thereby avoiding the damaging effects associated with typical electric heat drying apparatus. The fitted hair towel (1) is adapted to fit securely on the head so that it can be worn during any activity undertaken by the wearer without restricting the range of motion. An elasticized top edge (3) of the towel member (2) is wrapped from the back of the head at the hairline around the sides of the head to the forehead where inverted corners are secured by fasteners (8). The towel member (2) is wrapped around the hair to form a towel tube (19). The towel tube (19) is twisted and wrapped over the top and against the back of the wearer's head. A strap member (3) at the bottom edge (4) of the towel member (2) is pulled to draw together openings (14) located at the bottom edge (4), thereby gathering the bottom edge (4). Opposing ends (19 and 20) of the strap member (13) are wrapped around either side of the wearer's head and cooperative fastening means (17 and 18) are engaged at the wearer's forehead to secure the towel member (2) in a wrapped configuration.

18 Claims, 2 Drawing Sheets

FITTED HAIR TOWEL

FIELD OF THE INVENTION

The invention pertains to fitted hair towels and methods for drying hair conveniently and efficiently and providing a secure fit on the head of the wearer so that the activity and movement of the wearer is not restricted.

BACKGROUND OF THE INVENTION

There are many advantages and benefits to towel drying hair. Towel drying is a natural means of drying hair. It is not harsh on hair as is conventional electric heat apparatus for drying hair. The heat from electric apparatus such as hand held electric blow dryers and stationary electric cap dryers can damage hair, especially hair which has been chemically treated. Over a period of time, hair which has been exposed to electric heat may become limp, brittle, split at its ends, or otherwise damaged. Once damaged, the hair cannot be repaired and must be cut. In some cases, the hair is permanently damaged such that even new growth hair is damaged. In addition to permanently damaging hair, the electric heat apparatus can leave hair frizzy, unmanageable and straighten otherwise naturally curly or permanent waved hair.

Conventional electrically powered hair dryers confine the user to an area near an electrical outlet. The user is also restricted to the sole activity of drying hair when using a hand held electric blow dryer. While stationary electric cap drying does allow some activity, it is limited to that which involves relatively little head or body motion such as reading or writing.

Towel drying hair overcomes many of the disadvantages of electric heat apparatus. The hair drys naturally and thus no damages occurs. The hair remains healthy and manageable and not limp, brittle or split. Naturally curly or permanent waved hair retains its curls. In addition, towel drying can be accomplished to style waves into otherwise straight hair. Towel drying can occur anywhere, including outdoors, without an electrical source restfiction.

Conventional hair towels include bath and general purpose towels which are designed for purposes other than for drying hair. These multi-purpose towels have several disadvantages. They are bulky and many times include extraneous material which hinders and delays the drying process. These towels are not designed for use on the head. They are difficult to wrap around the head and once in place they fit either too loosely or tightly. The wearer must restrict the range of motion of the head in an effort to keep the towel in place. Consequently, the wearer cannot participate in activities while the hair is towel drying. Rather, the wearer must remain inactive including head movement. However, even when the wearer restricts body and head movement and remains inactive, conventional towels will fall from the head because of the poor fit. Even if these towels remain in position, they are typically uncomfortable because of the fit and the required inactivity of the wearer.

A hair towel which is specifically intended for drying and protecting hair is disclosed in U.S. Pat. No. 2,694,204 of Cross. The hair towel is more particularly a turban of an irregular rectilinear shape having two adjacent corner projections with metal-tipped points. The lower edge of the turban opposite the two corner projections has a pair of eyelets through which the metal-tipped points of the corner projections fit. To wear the turban, the lower edge is placed at the back of the head at the hair line. The remainder of the turban is wrapped around the head and along the hair line to the forehead. The excess material, including the corner projections, are twisted and brought back over the head. The metal-tipped points are inserted through the eyelets at the back of the head and the corner projections are tied tightly together. Such a turban has several disadvantages. First, the wearer must secure the turban around the head without the benefit of sight. Both tasks of inserting the metal-tipped points through the eyelets and tying the corner projections together are accomplished in the back of the wearer's head. The wearer cannot perform these maneuvers by sight and must resort to reliance on the senses of touch and memory. Second, the thickness of the turban material is necessarily limited by the size of the eyelets. As the corner projections widen from the narrow metal-tipped points toward the body of the turban, this extra material must be fed through the eyelets. If the material is too thick, insufficient length of the corner projections will fit through the eyelets to secure a proper fit around the head.

Another hair towel is disclosed in U.S. Pat. No. 2,568,399 of Kahn. This hair towel is more particularly a headgear comprising a tubular shaped towel. The tubular headgear has a V-shaped top opening. A plurality of hooks are at opposite sides of the V-shaped opening. Hooks are also located at the corners of the bottom of the tubular headgear. To wear the headgear, the head is bent over with the hair hanging downward. The tubular headgear is drawn over the hair and head beginning with the top opening. The head is then raised and the headgear is secured onto the head by fastening the hooks at the V-shaped opening. The bottom corners of the tubular member are raised above the head and brought down behind the head and around both sides of the head. The hooks located at the bottom corners are fastened under the chin. This tubular headgear has several disadvantages. First, the headgear has no elastic or gathers for a comfortable and secure fit around the head and hairline. While there are multiple hooks at the top opening to accommodate several head sizes, the fit is not as comfortable or secure as one would be with a headgear having elastic or gathers. Second, the headgear is not efficient and delays hair drying because it is not twisted around the hair to remove and absorb excess moisture from the hair. Third, the placement of the hooks under the chin can be annoying and uncomfortable to the wearer.

U.S. Pat. No. 2,263,418 of Ganim discloses a hair drying bonnet. This bonnet comprises a hood-like towel body with a pair of straps attached to the upper corners of the top. The bottom of the body includes an elastic band. In operation, the hair is placed on top of the head and the bonnet is slipped over the hair and head so that the bottom edge fits over the head at the hairline. The top of the bonnet is folded forward and the end of the straps are tied together at the back of the head. A disadvantage of this bonnet is that it does not efficiently or timely dry hair because it is not twisted around the hair to remove and absorb excess moisture. A further disadvantage is that the wearer does not have the benefit of sight for tying the straps at the back of the head.

A need exists for a fitted hair towel which overcomes the disadvantages found in the prior art. Such a towel should gently dry the hair, be easy to wrap and secure in place, be comfortable to wear and allow for freedom of movement and activity of the wearer.

SUMMARY OF THE INVENTION

This invention overcomes the disadvantages of conventional electric heat hair drying apparatus. In addition, by overcoming the disadvantages of the previously described devices for towel drying hair, this invention provides a fitted hair towel suitable for towel drying hair conveniently and efficiently and adapted to fit securely and comfortably on the head so that the wearer is not restricted in activities while the hair is towel drying. The wearer can freely move about and undertake almost any activity.

In its preferred embodiment, the fitted hair towel comprises a specially shaped towel constructed of any suitable water absorbent material and adapted for fitting securely and comfortably around the wearer's head. A top edge of the towel may be gathered, preferably by a elasticized strip. The elasticized strip ensures that the towel fits comfortably around various sizes or shapes of heads. A plurality of fasteners located at opposing ends of the top edge cooperatively engage at the wearer's forehead to secure the top edge around the wearer's head at the hairline.

Inverted corners are adjacent to the top edge of the towel to provide a lesser width of material at the top edge for a secure fit around the head. A greater width of material between the sides of the towel allows for ease of gripping and securing the top edge of the towel around the head and for wrapping the towel around the hair for optimal drying.

The bottom edge of the towel has a plurality of openings. A strap having two opposing ends extends through the openings and has an elasticized region near each opposing end. A cooperative fastener is attached to the opposing ends for securing the towel in a wrapped configuration.

The fitted hair towel is worn with the elasticized strip centered near the lower back of the wearer's head and the top edge of the towel wrapped around the head at the hairline and fastened over the forehead. The hair is wrapped in the towel and the bottom edge is gathered by pulling the strap and drawing together the openings. The towel is twisted and wrapped over the top and against the back of the head. The opposing ends of the strap are wrapped around either side of the wearer's head and are fastened at the forehead to secure the towel in its wrapped configuration.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE PREFERRED EMBODIMENT

Figure 1:
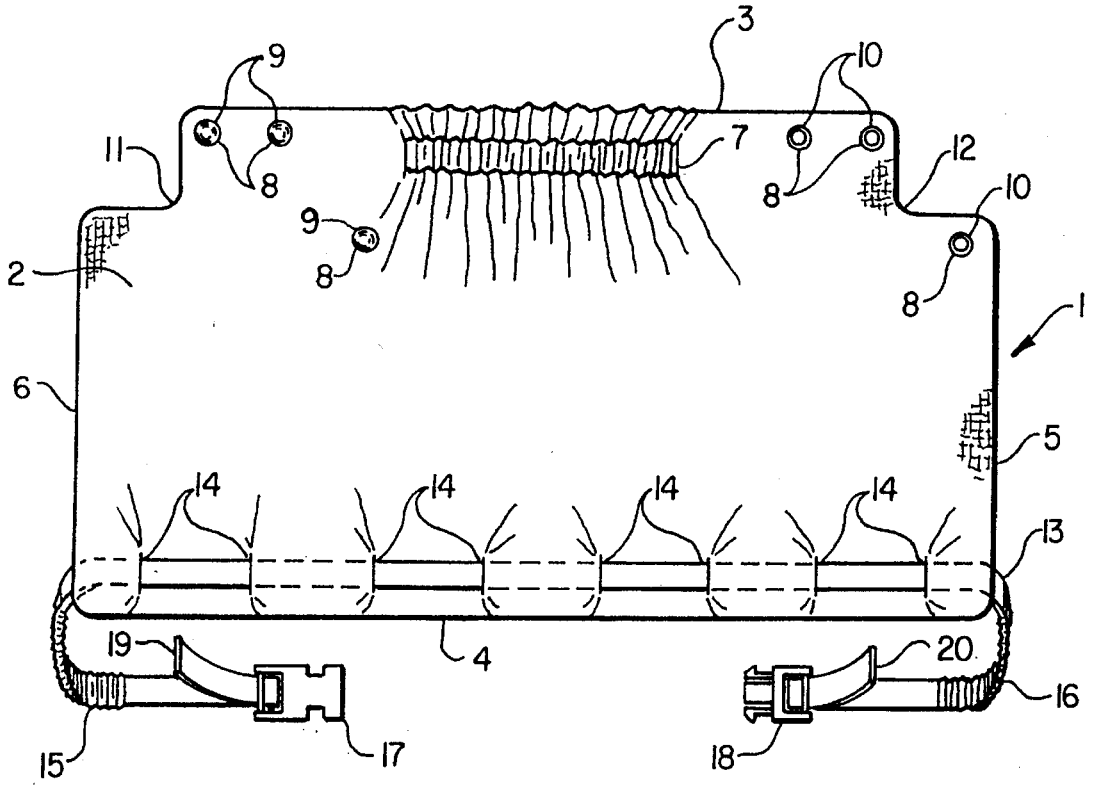
FIG. 1 provides a plane view of a fitted hair towel.

Referring to FIG. 1, a fitted hair towel 1 for drying hair on the head of a wearer includes a towel member 2 having a top edge 3, a bottom edge 4 and side edges 5 and 6. A gathering member 7 is attached to the towel member 2 at the top edge 3. The gathering member 7 is preferably an elasticized strip, although it will be understood by one skilled in the art that other gathering means are equivalent. A plurality of fasteners 8 are attached to the towel member 2 at opposed locations adjacent to the top edge 3. The fasteners 8 are preferably a plurality of snap fastener elements each having an outer portion 9 and a inner portion 10. However, it will be understood that other fastener means are suitable such as Velcro® hook and loop closure material or fastening tape. The towel member 2 includes inverted corners 11 and 12 adjacent to said top edge 3 proximate to said side edges 5 and 6. These inverted corners provide an optimal width of material at the top edge 3 to be fitted and secured around the head of the wearer. A greater width of material for the towel member 2 between the side edges 5 and 6 allows for ease of gripping and securing the top edge 3 of the towel member 2 around the head and for wrapping the towel member 2 around the hair for optimal drying. The inverted corners 11 and 12 may be reinforced for towel wear longevity.

A strap member 13 is attached to the towel member 2 adjacent to the bottom edge 4. The strap member 13 is configured to secure the towel member 2 in place on the wearer's head in a wrapped configuration. In its preferred embodiment, the strap member 13 has two opposing ends 19 and 20, although it will be understood that the strap member may have other configurements that are equivalent such as a circular band. A plurality of openings 14 extend transversely along the towel member 2 adjacent to the bottom edge 4. The strap member 13 extends through the openings 14 and cooperatively engages with the openings 14 to gather the bottom edge 4 of the towel member 2. The strap member 13 preferably has elasticized regions 15 and 16 proximate to the opposing ends 19 and 20 of the strap member 13. Cooperative fastening means 17 and 18 are attached to the opposing ends 19 and 20 of the strap member 13. Preferably the cooperative fastenings means 17 and 18 are engaging buckles, although it will be understood by one skilled in the art that equivalent fastening means exist such as Velcro®.

Figure 3:
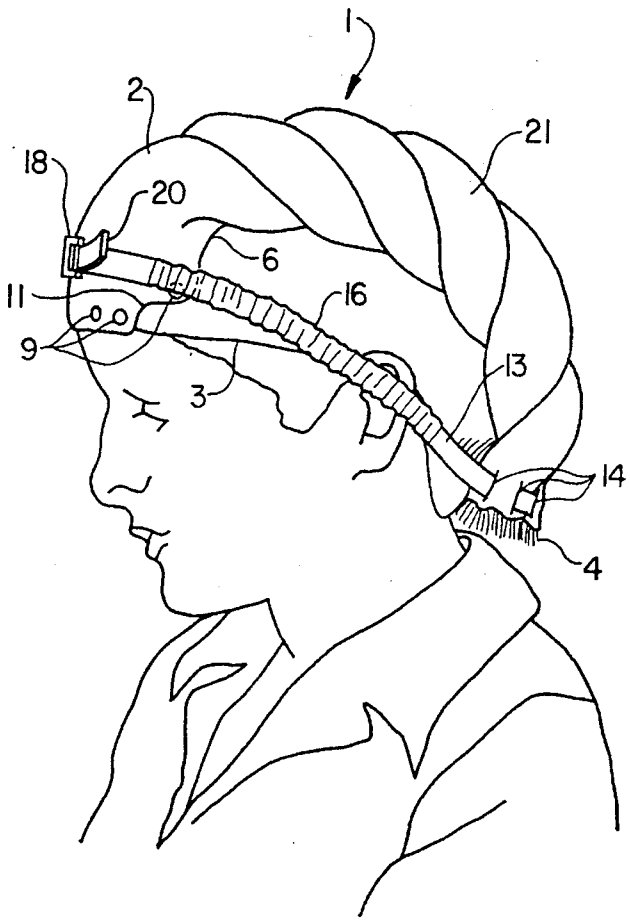
FIG. 3 provides a perspective view of a fitted hair towel in its wrapped configuration.
Figure 2:
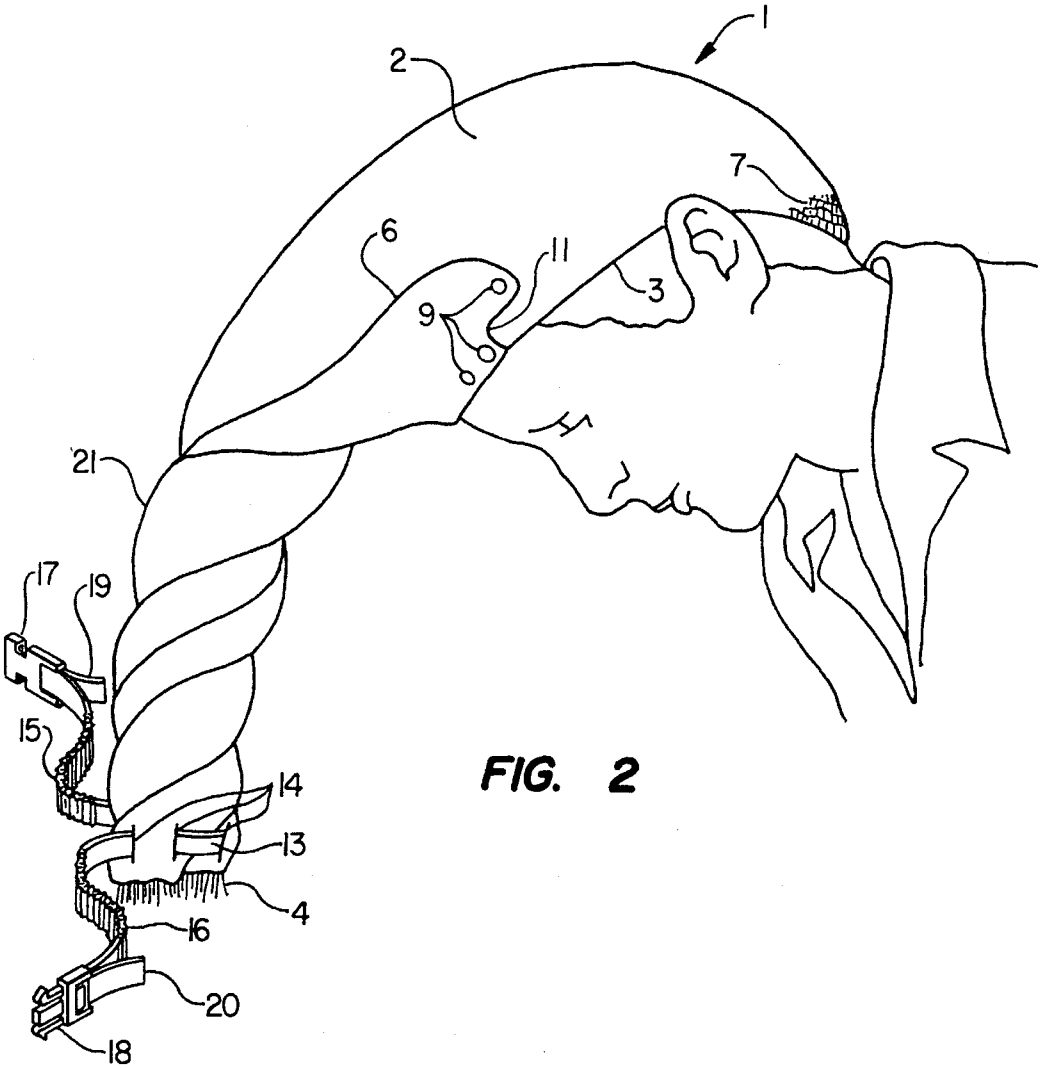
FIG. 2 provides a perspective view of an intermediate step in wrapping a fitted hair towel.

Referring now to FIGS. 1, 2 and 3 collectively, the wearer of the fitted hair towel 1 leans the head forward so that the hair hands down in front of the face. The gathering member 7 of the top edge 3 is centered at the back of the wearer's head at the hairline. The top edge 3 is wrapped around the head at the hairline to the wearer's forehead. The outer portions 9 of the fasteners 8 are engaged with the corresponding inner portions 10 at the wearer's forehead to secure the top edge 3 of the towel member 2 around the wearer's head. The towel member 2 is wrapped around the hair of the wearer by overlapping the side edges 6 and 7 to form a towel tube 21. The bottom edge 4 is gathered by pulling the opposing ends 19 and 20 of the strap member 13 to draw together the openings 14. The towel tube 21 is twisted to maximize surface contact of the towel member 2 with the hair. The wearer erects the head and wraps the towel member 2 over the top and against the back of the head. The opposing ends 19 and 20 of the strap member 13 are wrapped around either side of the head and the buckles 17 and 18 are fastened together.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of pans and elements as fall within the scope of the invention.

I claim:

1. A fitted hair towel for use on a head comprising:

an absorbent towel member having a top edge, a bottom edge and two side edges;

a plurality of fasteners attached to said towel member at opposed locations adjacent to said top edge;

a strap member attached to said towel member adjacent to said bottom edge and configured to secure said towel member in place in a wrapped configuration; and an expandable gathering member attached to said towel member adjacent to said top edge such that said expandable gathering member conforms snugly to said head.

2. A fitted hair towel, as recited in claim 1, wherein said expandable gathering member comprises an elasticized strip.

3. A fitted hair towel, as recited in claim 1, wherein said fasteners comprise a plurality of snap fastener elements.

4. A fitted hair towel, as recited in claim 3, wherein each of said snap fastener elements comprise an outer portion and an inner portion, said outer and inner portions attached to said towel member at opposed locations adjacent to said top edge.

5. A fitted hair towel, as recited in claim 1, wherein said towel member further comprises:

a plurality of openings extending generally transverse to said towel member adjacent to said bottom edge, wherein said strap member extends through said openings.

6. A fitted hair towel, as recited in claim 1, further comprising:

two inverted corners adjacent to said top edge of said towel member proximate to said side edges.

7. A fitted hair towel comprising:

an absorbent towel member having a top edge, a bottom edge and two side edges;

a plurality of fasteners attached to said towel member at opposed locations adjacent to said top edge;

a strap member attached to said towel member adjacent to said bottom edge and configured to secure said towel member in place in a wrapped configuration;

a gathering member attached to said towel member adjacent to said top edge such that said top edge captures the hair of the wearer; and two inverted corners adjacent to said top edge of said towel member proximate to said side edges.

8. A fitted hair towel, as recited in claim 7, wherein said towel member further comprises:

a plurality of openings extending generally transverse to said towel member adjacent to said bottom edge, wherein said strap member extends through said openings.

9. A fitted hair towel, as recited in claim 7, wherein said fasteners comprise a plurality of snap fastener elements.

10. A fitted hair towel, as recited in claim 9, wherein each of said snap fastener elements comprise an outer portion and an inner portion, said outer and inner portions attached to said towel member at opposed locations adjacent to said top edge.

11. A fitted hair towel, as recited in claim 7, wherein said gathering member comprises an elasticized strip.

12. A fitted hair towel, as recited in claim 7, wherein said strap member comprises two opposing ends and an elasticized region proximate to each of said opposing ends.

13. A fitted hair towel, as recited in claim 12, further comprising:

a cooperative fastening means attached to said opposing ends of said strap member.

14. A method for towel drying hair on the head of a wearer comprising the steps of: providing a fitted hair towel comprising:

a towel member having a top edge, a bottom edge and two side edges, a plurality of fasteners attached to said towel member at opposed locations adjacent to said top edge, a gathering member attached to said towel member adjacent to said top edge, and a strap member attached to said towel member adjacent to said bottom edge and configured to secure said towel member in place in a wrapped configuration;

wrapping said top edge of said towel member around the wearer's head which is positioned with the hair hanging down in front of the face;

engaging said plurality of fasteners at the forehead of the wearer to secure said top edge of said towel member around the head of the wearer and to provide an overlap of said side edges of said towel member;

forming a towel tube by wrapping said towel member around the hair of the wearer;

twisting said towel tube to maximize the surface contact of said towel member with the hair of the wearer;

wrapping said towel tube over the top and against the back of the wearer's head; and engaging said strap member to secure said towel tube in a wrapped configuration.

15. The method of claim 14, wherein said step of providing a fitted hair towel further comprises:

providing a towel member including a plurality of openings extending generally transverse to said towel member adjacent to said bottom edge, wherein said strap member extends through said openings.

16. The method of claim 15, further comprising the step of:

gathering said bottom edge of said towel member by drawing together said openings along said strap member extending therethrough.

17. The method of claim 16, wherein said step of providing a fitted hair towel further comprises:

providing said strap member with two opposing ends and an elasticized region proximate to each of said opposing ends, and a cooperative fastening means attached to said opposing ends of said strap member for connecting said ends together.

18. The method of claim 17, further comprising the steps of:

wrapping said opposing ends of said strap member around either side of the wearer's head; and engaging said cooperative fastening means at the wearer's forehead to secure said towel member in a wrapped configuration.

* * * * *

UNITED STATES PATENT AND TRADEMARK OFFICE

CERTIFICATE OF CORRECTION

PATENT NO. : 5,490,528

DATED : February 13, 1996

INVENTOR(S) : Scott A. Day

It is certified that error appears in the above-indentified patent and that said Letters Patent is hereby corrected as shown below:

Col. 1, line 40, "restfiction" should be --restriction--.

Col. 4, line 33, "hands" should be --hangs--.

Col. 4, line 60, "pans" should be --parts--.

Signed and Sealed this

Sixth Day of May, 1997

*Attest:*

*Attesting Officer*

Bruce Lehman

BRUCE LEHMAN

*Commissioner of Patents and Trademarks*